US009783270B2

(12) United States Patent
Van Der Zee

(10) Patent No.: US 9,783,270 B2
(45) Date of Patent: Oct. 10, 2017

(54) SYSTEM AND METHOD FOR LAUNCHING AND RECOVERING A DAUGHTER BOAT FROM A STERN OF A MOTHER SHIP

(71) Applicant: HIGH-TECH SOLUTIONS & DESIGN B.V., Zuidhorn (NL)

(72) Inventor: Anno Adriaan Van Der Zee, Zuidhorn (NL)

(73) Assignee: High-Tech Solutions & Design B.V., Zuidhorn (NL)

( * ) Notice: Subject to any disclaimer, the term of this patent is extended or adjusted under 35 U.S.C. 154(b) by 0 days.

(21) Appl. No.: 15/324,624

(22) PCT Filed: Jul. 9, 2015

(86) PCT No.: PCT/NL2015/050503
§ 371 (c)(1),
(2) Date: Jan. 6, 2017

(87) PCT Pub. No.: WO2016/007008
PCT Pub. Date: Jan. 14, 2016

(65) Prior Publication Data

US 2017/0203816 A1 Jul. 20, 2017

(30) Foreign Application Priority Data

Jul. 10, 2014 (NL) ..... 2013163

(51) Int. Cl.
*B63B 23/32* (2006.01)
*B63B 23/34* (2006.01)
(Continued)

(52) U.S. Cl.
CPC ..... *B63B 23/32* (2013.01); *B63B 23/34* (2013.01); *B63B 27/08* (2013.01); *B63B 27/143* (2013.01);
(Continued)

(58) Field of Classification Search
CPC ..... B63B 23/32; B63B 23/34
(Continued)

(56) References Cited

U.S. PATENT DOCUMENTS 5,483,912 A 1/1996 Thomas
5,533,834 A * 7/1996 Recalde ..... F16L 1/202 405/166
(Continued)

OTHER PUBLICATIONS

WIPO, "Search Report," PCT/NL2015/050503, dated Oct. 9, 2015.

*Primary Examiner* — Lars A Olson
*Assistant Examiner* — Jovon Hayes
(74) *Attorney, Agent, or Firm* — Emerson Thomson Bennett, LLC; Daniel A. Thomson

(57) ABSTRACT

In a system (1) for launching, and recovering, a daughter boat (3) from a stern of a mother ship (2), there is provided a telescopic stern ramp of the mother ship. In the telescopic stern ramp, a landing frame (5) has a telescopic retracted position and a telescopic extended position. Furthermore, the landing frame is reciprocally pivotable between said telescopic extended position and a boat landing pivot position. During a boat recovering operation, the boat landing pivot position of the landing frame allows for reliable and quick fastening of the daughter boat to the mother ship. The telescopic retracted position of the landing frame allows for stowing the daughter boat in the stern area of the mother ship.

7 Claims, 12 Drawing Sheets

(51) Int. Cl.
*B63B 35/40* (2006.01)
*B63B 27/08* (2006.01)
*B63B 27/14* (2006.01)

(52) U.S. Cl.
CPC ..... *B63B 35/40* (2013.01); *B63B 2027/141* (2013.01); *B63B 2708/00* (2013.01)

(58) Field of Classification Search
USPC ..... 114/258, 259
See application file for complete search history.

(56) References Cited

U.S. PATENT DOCUMENTS 5,904,113 A * 5/1999 Slikkers ..... B63B 23/30 114/259
6,047,659 A * 4/2000 Schmidt, Jr. ..... B63B 23/32 114/369
6,363,873 B2 * 4/2002 Thomas ..... B63B 35/32 114/259
6,591,770 B1 7/2003 Blackmore
6,779,475 B1 * 8/2004 Crane ..... B63B 27/10 114/258
7,475,649 B2 * 1/2009 Shepherd ..... B63B 23/06 114/259
7,546,814 B1 6/2009 Said
7,634,971 B2 * 12/2009 Lucas ..... B63B 1/08 114/61.15
8,967,067 B2 * 3/2015 Soreau ..... B63B 23/32 114/258
2011/0205840 A1 * 8/2011 Hayes ..... G01V 1/3843 367/20
2012/0204363 A1 * 8/2012 Westermark ..... B63B 27/143 14/71.3
2013/0000542 A1 * 1/2013 Muller ..... B63B 23/32 114/362

* cited by examiner

SYSTEM AND METHOD FOR LAUNCHING AND RECOVERING A DAUGHTER BOAT FROM A STERN OF A MOTHER SHIP

The invention relates to a system and a method for launching, and recovering, a daughter boat from a stern of a mother ship.

For many organisations, such as coast guards, small boats are essential to the successful execution of their missions. The ability to launch and recover small and fast daughter boats from larger mother vessels in a broad range of sea states and other environmental conditions is essential to successfully complete such missions.

Stern launch and recovery is often done by means of a stern ramp in a mother ship. With known stern ramp systems, the launching of daughter boats is not the most difficult part. The recovery of daughter boats, however, is very difficult. In a recovery operation, the daughter boat typically has to accelerate considerably towards the mother ship, whereafter it moves with high speed up the ramp, where it is captured. Next, the daughter boat is stowed, in one way or another, onboard the mother ship in its stern region. Especially in cases of heavy sea states, these recovery operations are relatively unreliable and unsafe. Capturing the boat on the stern ramp often fails, which leads to multiple recovery attempts that have to be undertaken. Also, these recovery operations bring along many collisions between the fast moving daughter boats and the mother ships.

U.S. Pat. No. 6,047,659A discloses a very different device as compared to the abovementioned known stern ramp systems in which a high powered daughter boat has to thrust itself with high speed up the ramp. In fact U.S. Pat. No. 6,047,659A merely discloses a basic lift mounted to the transom of a boat. The lift has a horizontal platform 52 for raising, holding and carrying small personal watercraft, such as an inflatable rubber boat. The platform 52 is secured, by means of brackets 54, to a telescopic construction, by which the platform is raised and lowered. The brackets 54 keep the platform horizontal at all times for raising, holding and carrying the small personal watercraft on the platform.

It is an object of the invention to improve the reliability and safety of launching, and recovering, a daughter boat from a stern of a mother ship, especially in heavy sea states and in other harsh environmental conditions.

For that purpose, the invention provides a stern ramp launch and recovery system according to the appended independent claim 1, as well as a method according to the appended independent claim 7. Specific embodiments of the invention are set forth in the appended dependent claims 2-6.

Hence, the invention provides a stern ramp launch and recovery system for launching, and recovering, a daughter boat from a stern of a mother ship, the system comprising a main frame, a landing frame for supporting the daughter boat, a first translation guiding structure, a second translation guiding structure, a translation movement mechanism, a rotation guiding structure, and a rotation movement mechanism, wherein the system is configured to be in an operation condition, in which the system is forming a telescopic stern ramp of the mother ship, said telescopic stern ramp having an inclined stern ramp length axis having a descending slope in rearward direction of the mother ship, and in which operation condition:

the first translation guiding structure is attached to the mother ship along the stern, whereby the first translation guiding structure defines said inclined stern ramp length axis, as well as a corresponding stern ramp width axis, of said telescopic stern ramp;

the main frame is held by the mother ship and by the first translation guiding structure in a first reciprocally translatable manner along said inclined stern ramp length axis, said first translatable manner being relative to the stern;

the landing frame is held by the main frame and by the second translation guiding structure in a second reciprocally translatable manner along said inclined stern ramp length axis, said second translatable manner being relative to the main frame;

the translation movement mechanism effects and controls movements according to said first reciprocally translatable manner and said second reciprocally translatable manner;

said first reciprocally translatable manner and said second reciprocally translatable manner are allowing the landing frame to reciprocally translate between at least one telescopic retracted position and at least one telescopic extended position, wherein the landing frame in its telescopic extended position is farther descended along said inclined stern ramp length axis than in its telescopic retracted position;

the landing frame is held by the main frame and by the rotation guiding structure in a reciprocally pivotable manner relative to the main frame, about a pivot axis being parallel to said stern ramp width axis, between said telescopic extended position of the landing frame and at least one boat landing pivot position in which the landing frame has less inclination as compared to the inclined stern ramp length axis; and the rotation movement mechanism effects and controls movements according to said reciprocally pivotable manner.

Also, the invention provides a method of launching, and recovering, a daughter boat from a stern of a mother ship, wherein:

a stern ramp launch and recovery system according to the invention is installed in its operation condition on the mother ship;

said recovering comprises the consecutive steps of:

(i) sailing the daughter boat onto the landing frame being in a first one of said at least one boat landing pivot position, while fastening the daughter boat, sailed onto the landing frame, to the landing frame;

(ii) pivoting the landing frame from said first boat landing pivot position into a first one of said at least one telescopic extended position;

(iii) translating the landing frame from said first telescopic extended position into a first one of said at least one telescopic retracted position;

and said launching comprises the consecutive steps of:

(iv) translating the landing frame from a second one of said at least one telescopic retracted position into a second one of said at least one telescopic extended position, while the landing frame is supporting the daughter boat, which is fastened thereto;

(v) pivoting the landing frame from said second telescopic extended position into a second one of said at least one boat landing pivot position;

(vi) unfastening, in said second boat landing pivot position, the daughter boat from the landing frame and releasing the daughter boat from the landing frame.

Hence, according to the invention, the landing frame may, amongst others, be in a certain one of said at least one telescopic retracted position, a certain one of said at least one telescopic extended position, and a certain one of said at least one boat landing pivot position. For simplicity, each of these "certain one of said at least one ( . . . ) position" hereinafter sometimes is simply referred to as "the ( . . . ) position" or "said ( . . . ) position".

At the start of a recovery operation, the landing frame is in said boat landing pivot position. Since in this boat landing pivot position the landing frame is close to the water surface and does not have the high steepness of the inclined stern ramp length axis, the daughter boat is allowed to sail easily and reliably onto the landing frame and with much lower speed as would be required in case of sailing onto a steeper stern ramp. In fact, the boat landing pivot position may be considered as a "safe harbour" outboard of the mother ship. This safe outboard harbour situation allows for reliable and quick fastening of the daughter boat to the landing frame. In other words it allows for reliable and quick fastening of the daughter boat to the mother ship. Thanks to this reliable and quick fastening, adverse effects of heavy sea states or other harsh environmental conditions are quickly eliminated in a very early stage of the recovery operation. In the successive steps of the recovery operation, the landing frame together with the daughter boat, being supported thereby and being fastened thereto, are brought onboard of the mother ship. That is, the landing frame first is pivoted into said telescopic extended position, and thereafter it is translated into said telescopic retracted position.

It is noted that the invention not only improves the reliability and safety of the recovery operation. In fact, the invention also improves the reliability and safety of the launching operation. That is, the invention allows for bringing the landing frame together with the daughter boat outboard of the mother ship in a very controlled manner. After all, during the translating of the landing frame from said telescopic retracted position into said telescopic extended position, and during the successive pivoting of the landing frame from this telescopic extended position into the boat landing pivot position, the daughter boat may be supported by, and fastened to, the landing frame. When the landing frame is in the boat landing pivot position, one can simply await an optimum moment in time for unfastening the daughter boat from the landing frame to thereby complete the actual launching of the daughter boat.

In a preferable embodiment of a stern ramp launch and recovery system according to the invention, the translation movement mechanism is configured to effect that:

- movements, according to said first reciprocally translatable manner, of the main frame relative to the stern, on the one hand; and
- movements, according to said second reciprocally translatable manner, of the landing frame relative to the main frame, on the other hand;

take place simultaneously and in the same direction of said inclined stern ramp length axis.

Said simultaneity of movements in said same direction offers the advantage that it speeds up the retracting and extending movements of the telescopic stern ramp of the system.

In a further preferable embodiment of a stern ramp launch and recovery system according to the invention, the rotation guiding structure comprises a first auxiliary frame, which is configured to follow the landing frame to reciprocally translate between said at least one telescopic retracted position and said at least one telescopic extended position, and which is hingeably connected to the landing frame with a hinge axis being parallel to said stern ramp width axis and being spaced from said pivot axis. The application of such a first auxiliary frame allows for evenly distributed forces between the landing frame and the main frame during pivoting of the landing frame relative to the main frame.

In a further preferable embodiment of a stern ramp launch and recovery system according to the invention, the system further comprises at least one sensor, which in said operation condition is configured, arranged and effective to sense at least one property of water waves in the neighbourhood of the mother ship. Various properties of water waves may thus be sensed, such as wave heights and/or wave lengths and/or travelling directions and/or travelling speeds of waves, etc. The sensed properties may be monitored, analyzed, displayed, etc., for assisting in, e.g., the timing regarding the undertaking of launching and recovering operations, and/or in setting various other parameters of performing launching and recovering operations.

In a further preferable embodiment of a stern ramp launch and recovery system according to the invention, the system further comprises at least one calculator, which is communicatively connected to said at least one sensor, and which in said operation condition is configured, arranged and effective to calculate, based on said at least one property sensed by said at least one sensor:

- a suitable moment in time for starting up launching or recovering a daughter boat by means of the stern ramp launch and recovery system; and/or
- proposed operation parameters of the stern ramp launch and recovery system; and/or
- proposed alterations in the sailing characteristics of the mother ship relative to the water waves in the neighbourhood of the mother ship, which proposed alterations are influencing the relative movements between said water waves and the mother ship in a manner so as to make launching or recovering a daughter boat by means of the stern ramp launch and recovery system easier and/or safer.

Such a calculator provides powerful assistance for performing launching and recovering operations. The values calculated may for example be displayed for decision makers in the launching and recovering operations. Additionally or alternatively, the values calculated by the calculator may also for example be automatically communicated to at least one controller, which in said operation condition is configured, arranged and effective to control the stern ramp launch and recovery system and/or to control the mother ship (e.g. as to the direction and speed of the mother ship relative to the water waves).

The abovementioned aspects and other aspects of the invention will be apparent from and elucidated with reference to the embodiments described hereinafter by way of non-limiting examples only and with reference to the schematic figures in the enclosed drawing.

Figure 1A:
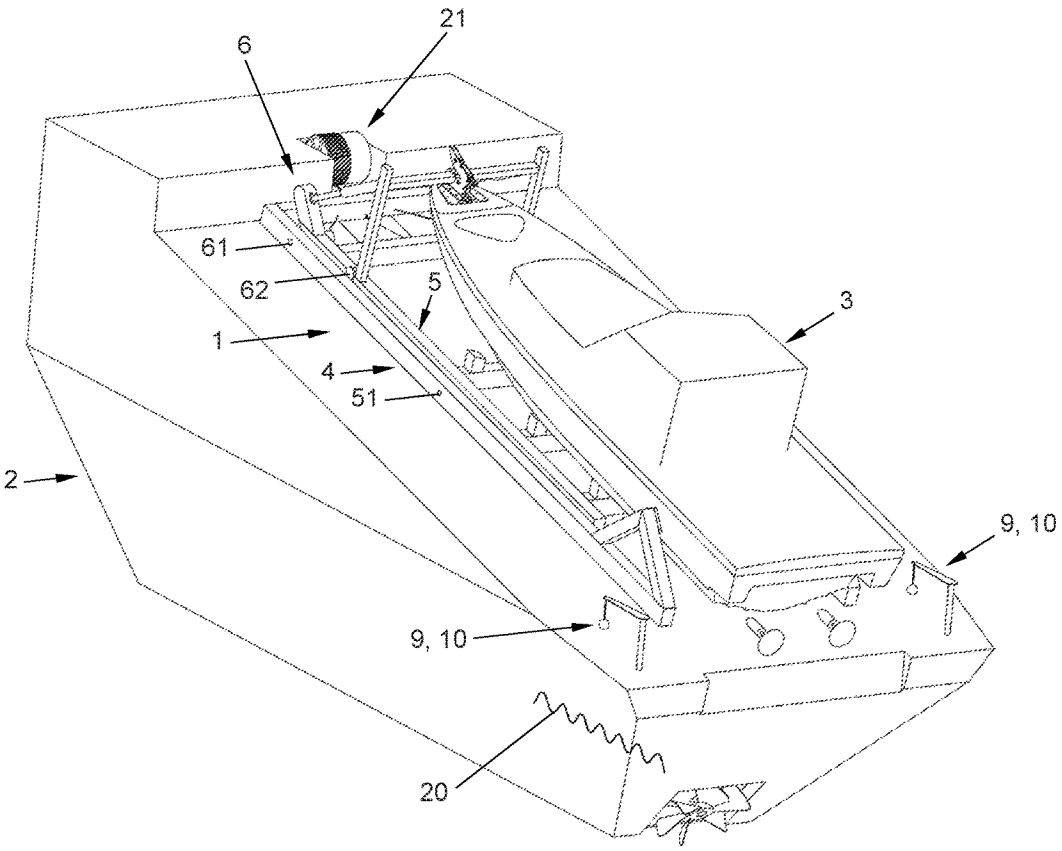
FIG. 1A shows, in a perspective view, an example of an embodiment of a stern ramp launch and recovery system according to the invention, wherein the system is installed on a mother ship, and wherein the landing frame of the system is in the telescopic retracted position, and wherein the landing frame is supporting a daughter boat, which is fastened thereto.

It is noted that, when the same reference signs are used throughout different ones of the abovementioned FIGS. 1A through 7B, these reference signs denote the same or similar parts or aspects. It is furthermore noted that throughout most of these Figures there is shown a wavy line indicated by reference numeral 20. This wavy line 20 indicates the position of the water surface of the water in which the mother ship, on which the system according to the invention is installed, is floating.

Reference is first made to the embodiment of FIGS. 1A through 5, which show the stern ramp launch and recovery system 1 according to the invention. Therein, the mother ship and the daughter boat are indicated by the reference numerals 2 and 3, respectively, while the main frame and the landing frame of system 1 are indicated by the reference numerals 4 and 5, respectively. The inclined stern ramp length axis, and the stern ramp width axis are indicated by the reference numerals 7 and 8, respectively.

Figure 1B:
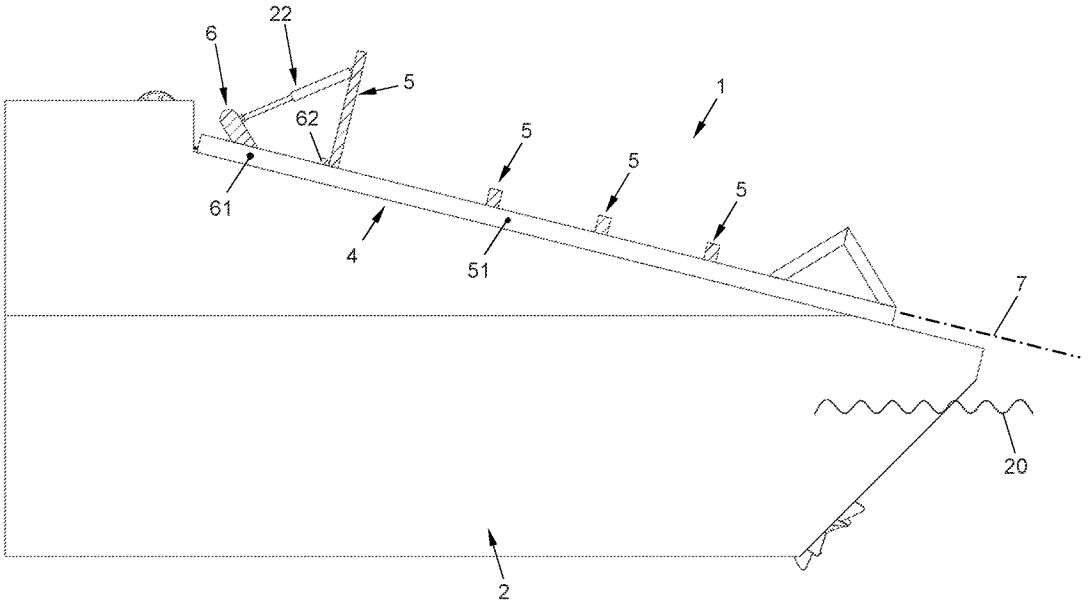
FIG. 1B shows the situation of FIG. 1A in a side view, however, wherein for reasons of simplicity the daughter boat has been omitted.
Figure 2A:
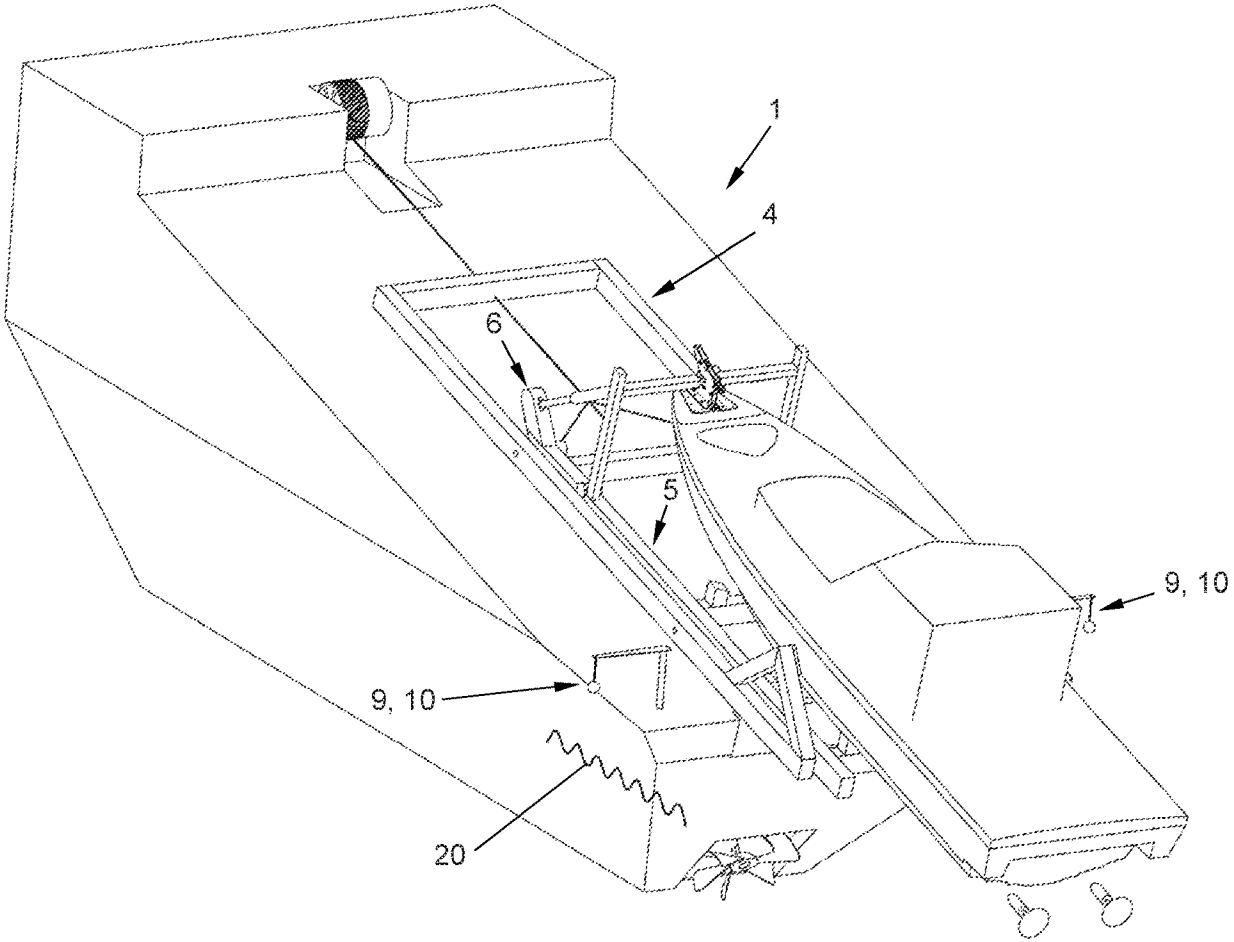
FIG. 2A shows the similar situation of FIG. 1A in the perspective view again, however, wherein the landing frame has been translated from the telescopic retracted position into an intermediate telescopic position between the telescopic retracted position and the telescopic extended position.
Figure 2B:
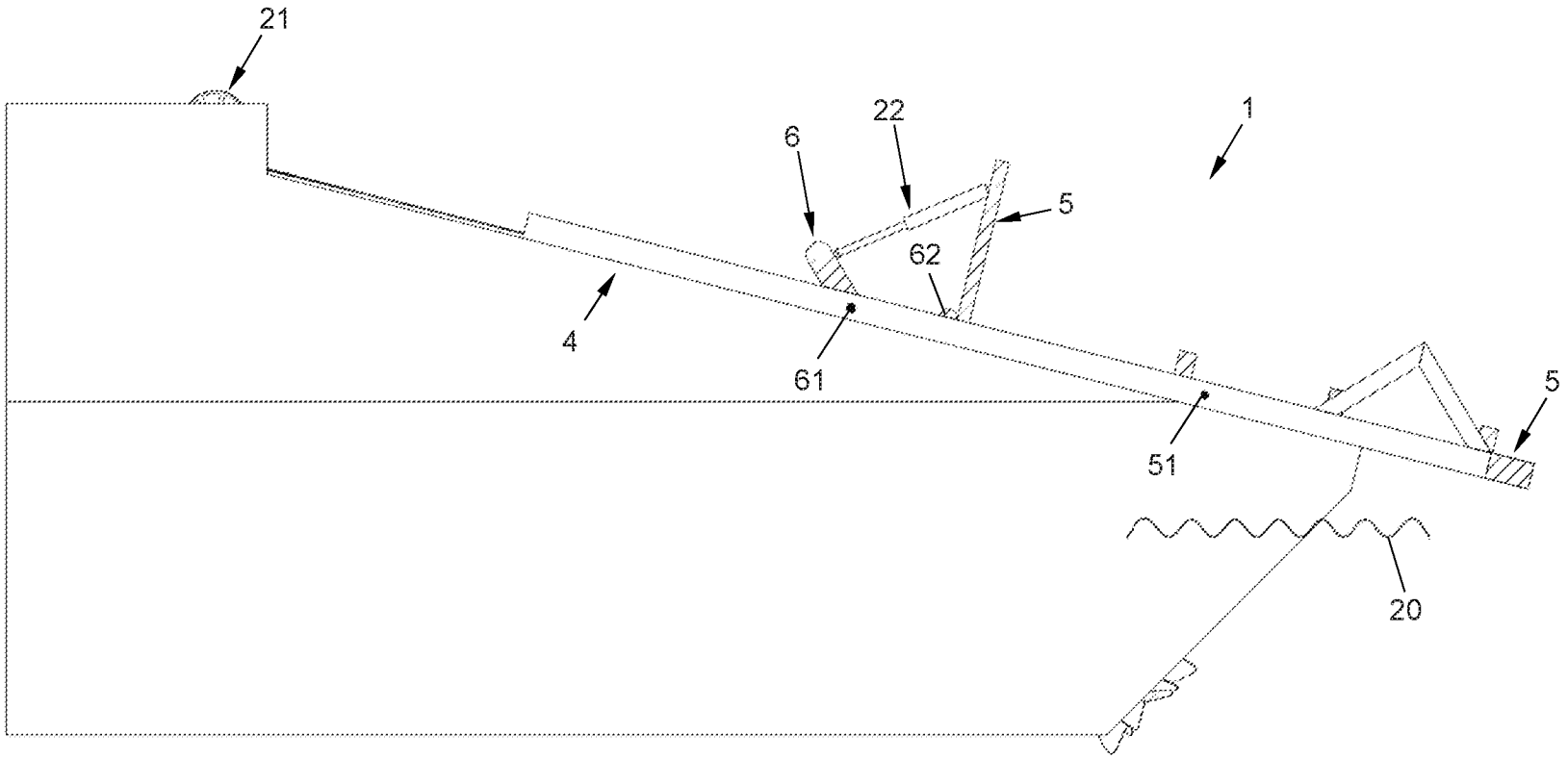
FIG. 2B shows the situation of FIG. 2A, but now in the side view and with omitted daughter boat again.
Figure 3A:
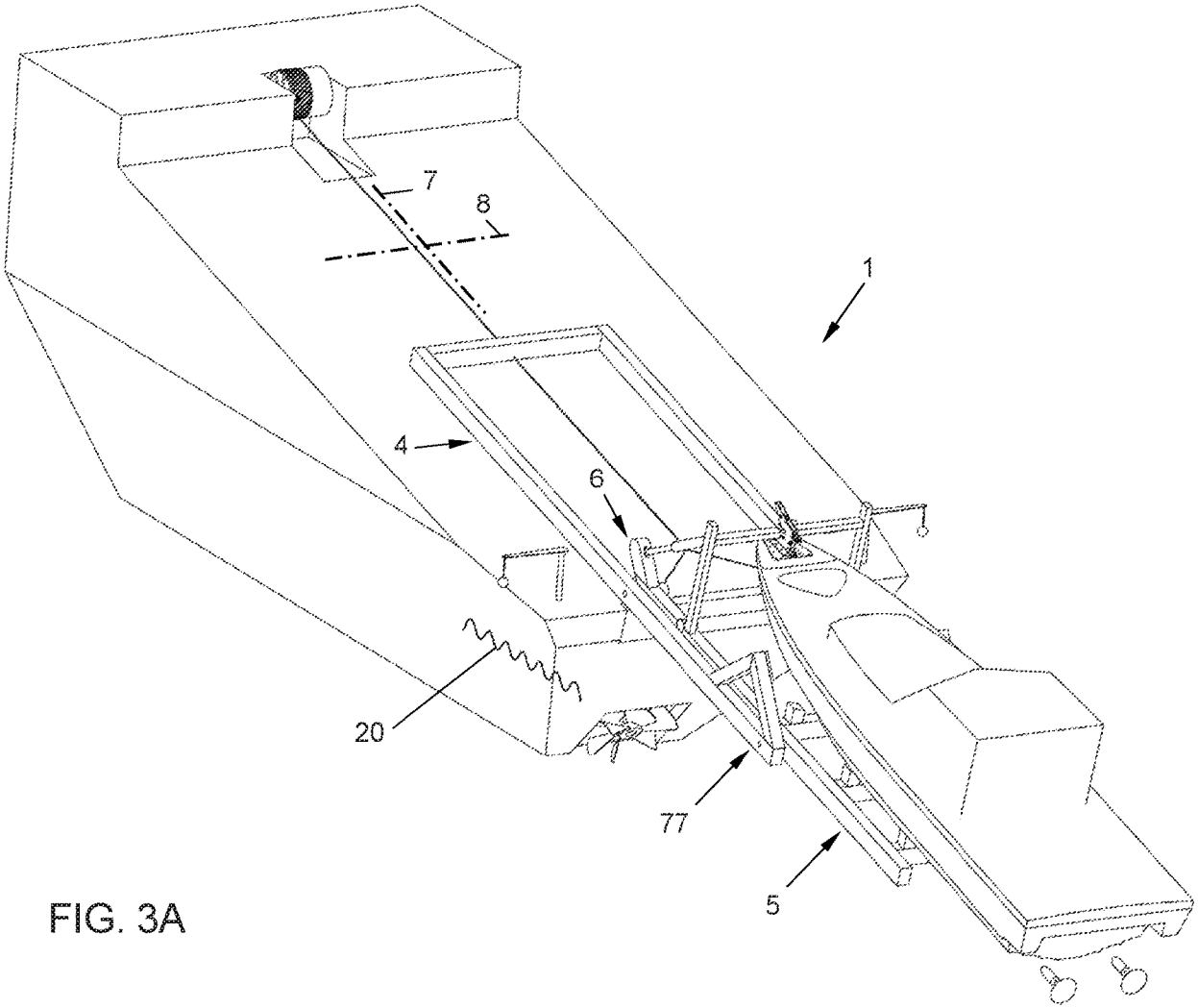
FIG. 3A shows the similar situation of FIG. 2A in the perspective view again, however, wherein the landing frame has been translated from the telescopic intermediate position into the telescopic extended position.
Figure 3B:
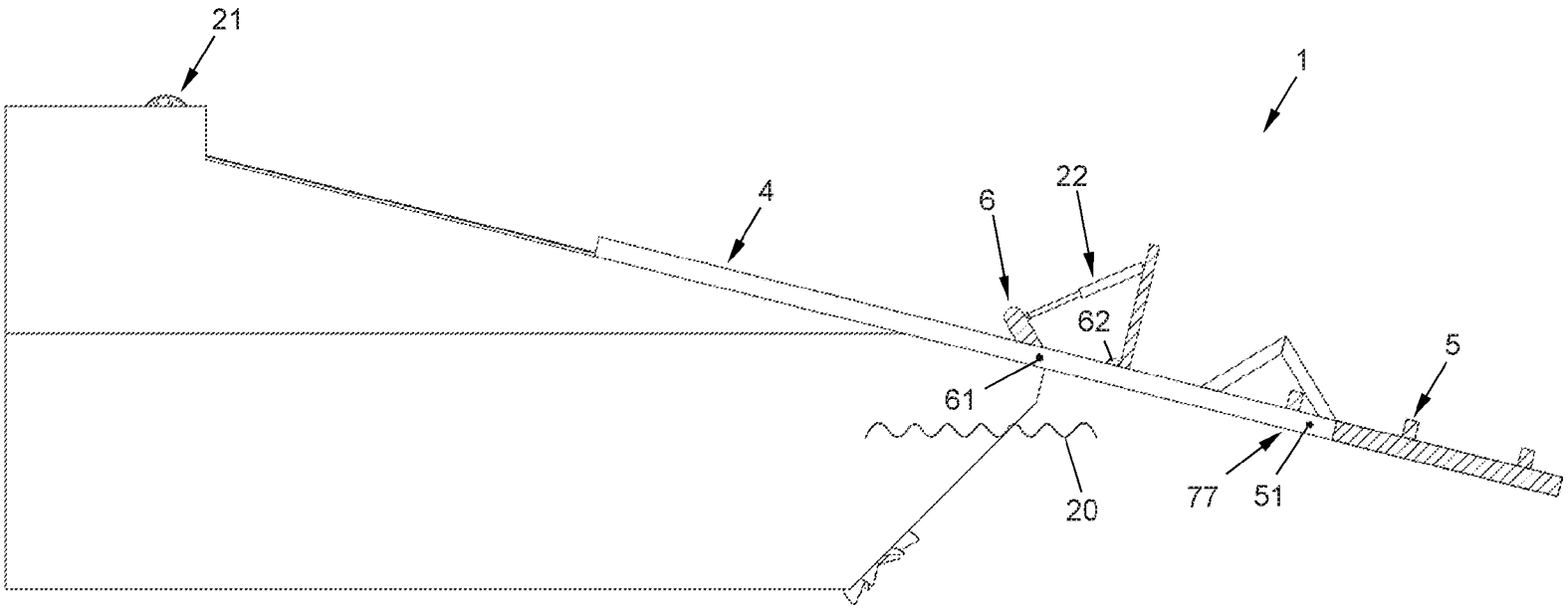
FIG. 3B shows the situation of FIG. 3A, but now in the side view and with omitted daughter boat again.
Figure 4A:
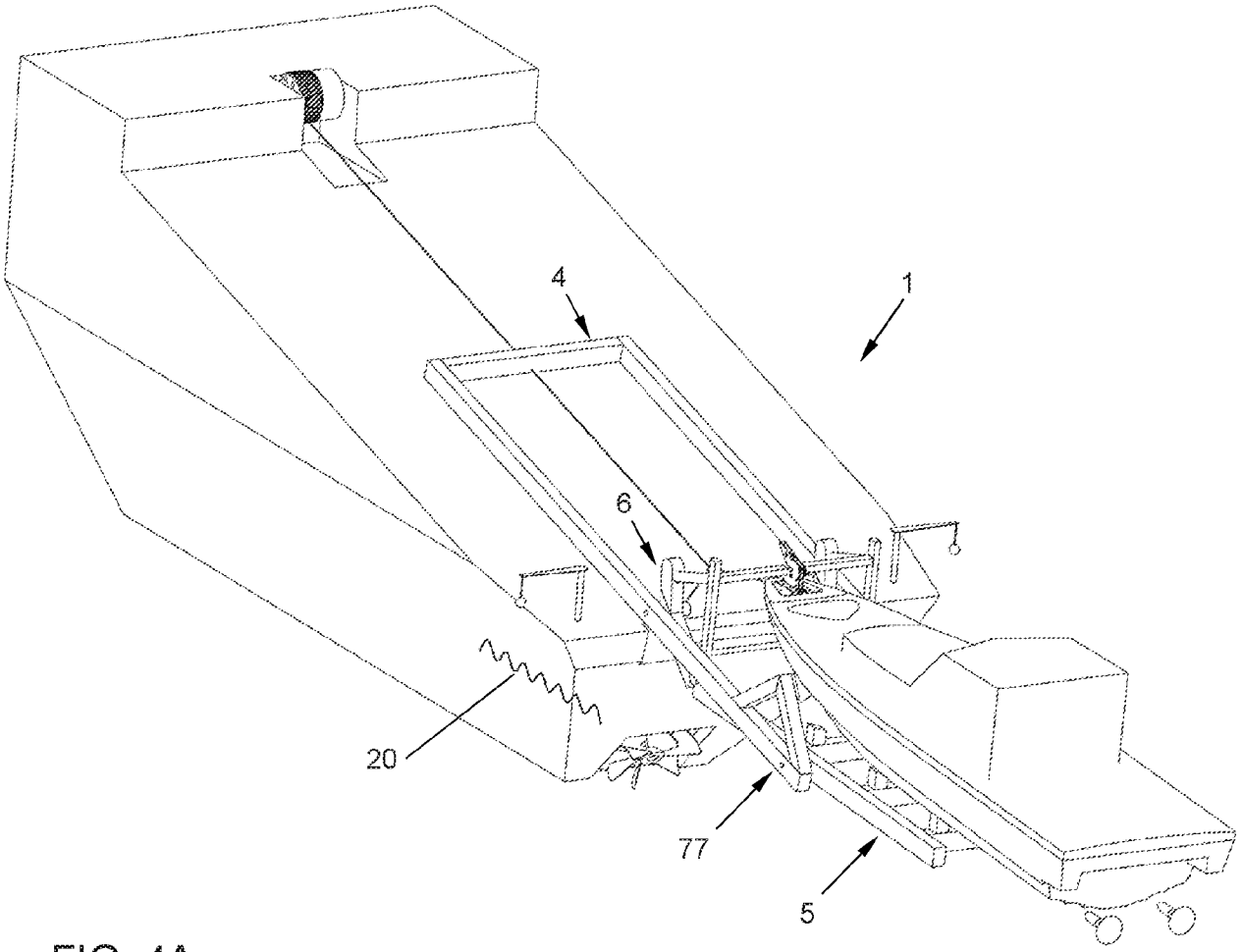
FIG. 4A shows the similar situation of FIG. 3A in the perspective view again, however, wherein the landing frame has been pivoted from the telescopic extended position into the boat landing pivot position.
Figure 4B:
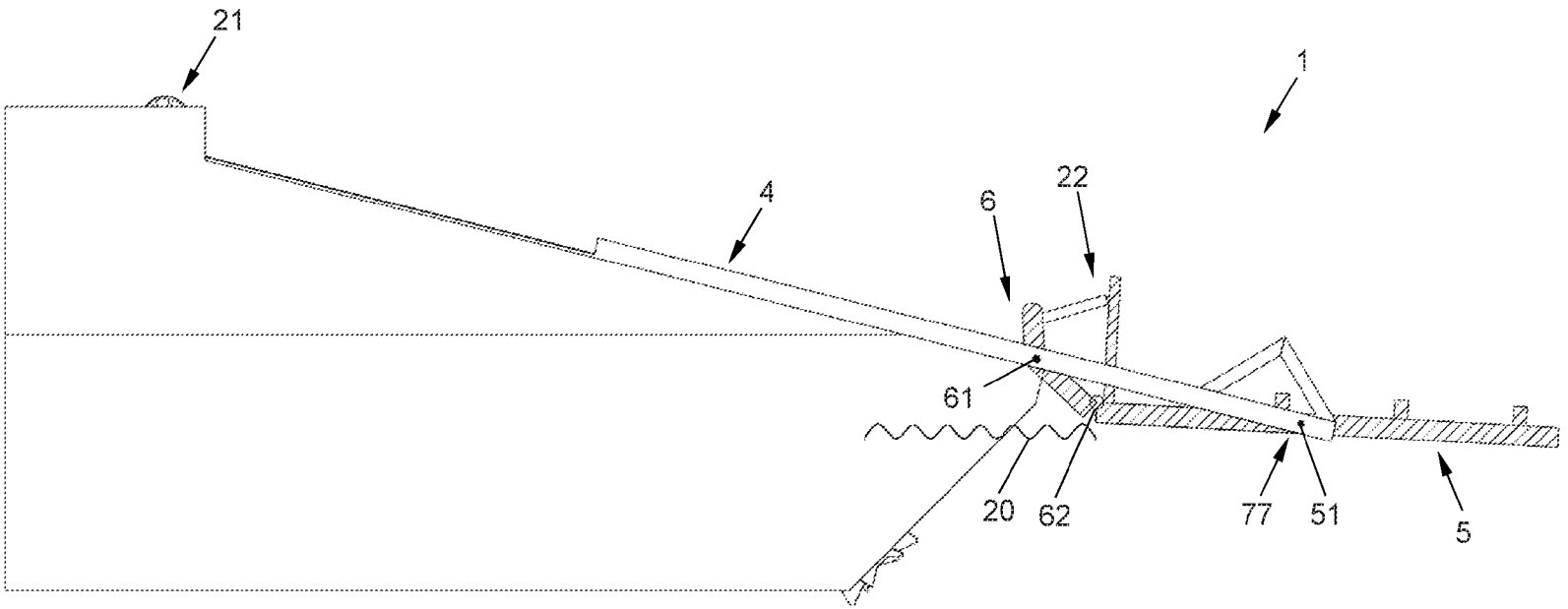
FIG. 4B shows the situation of FIG. 4A, but now in the side view with omitted daughter boat again.
Figure 5:
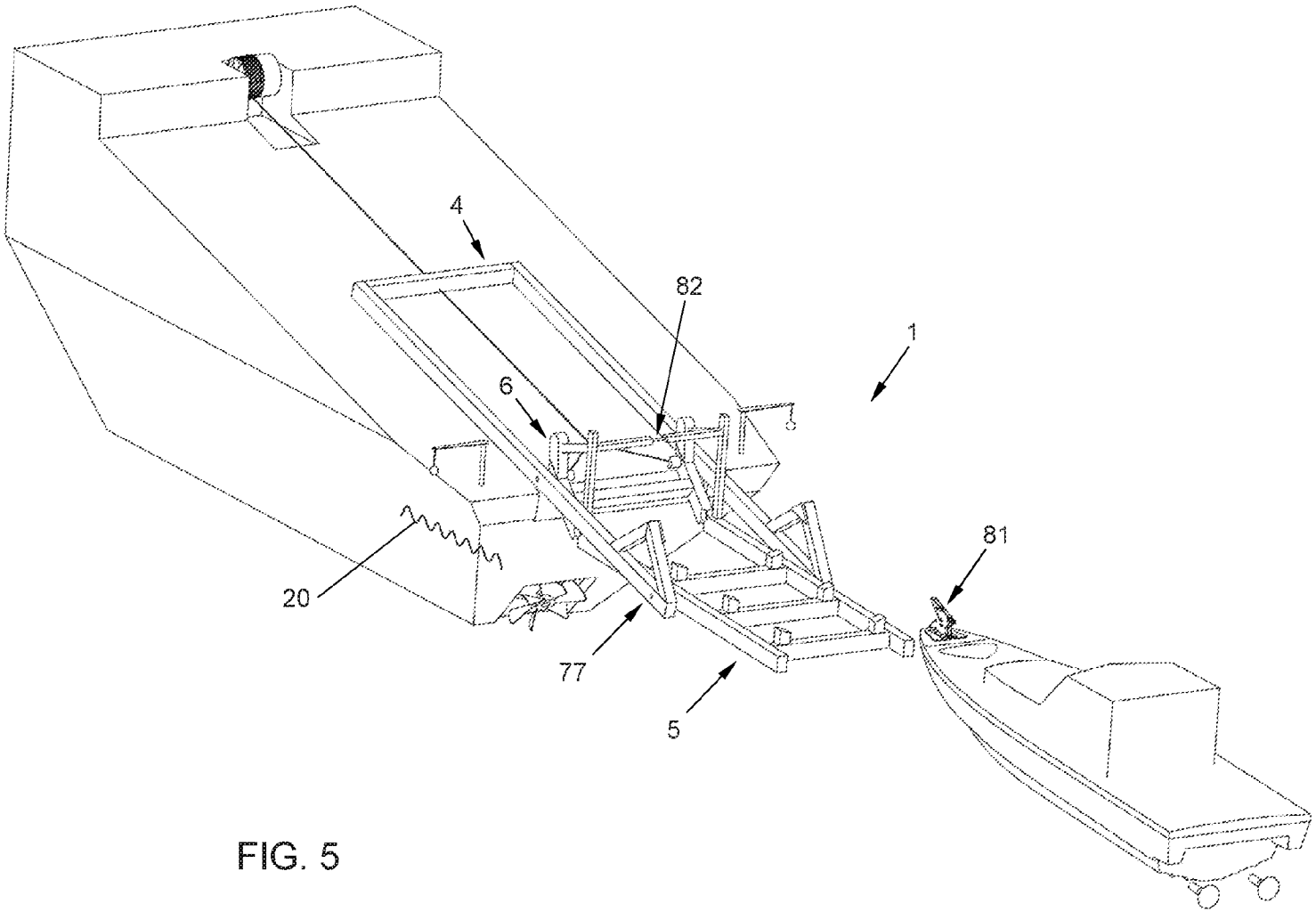
FIG. 5 shows the similar situation of FIG. 4A in the perspective view again, however, wherein in the boat landing pivot position the daughter boat has been unfastened and released from the landing frame.

As mentioned, in FIGS. 1A, 1B the landing frame 5 is in the "telescopic retracted position", in FIGS. 2A, 2B it is in the said "intermediate telescopic position", in FIGS. 3A, 3B it is in the "telescopic extended position", and in FIGS. 4A, 4B, 5 in the "boat landing pivot position". When only looking at the consecutive FIGS. 1A, 2A, 3A, 4A, and 5, it will be clear that these consecutive Figures illustrate five successive moments in time, respectively, during launching the daughter boat 3 from the stern of the mother ship 2, according to an example of an embodiment of a method according to the invention. Similarly, it will be clear that these consecutive Figures, as seen in reverse order, illustrate five successive moments in time, respectively, during recovering the daughter boat 3 at the stern of the mother ship 2, according to an example of an embodiment of a method according to the invention. Note that reference numerals 81 and 82 in FIG. 5 indicate an automatic catch system, which comprises the catch hook 81 mounted on the daughter boat 3, and the catch rod 82 mounted on the landing frame 5.

Figure 6:
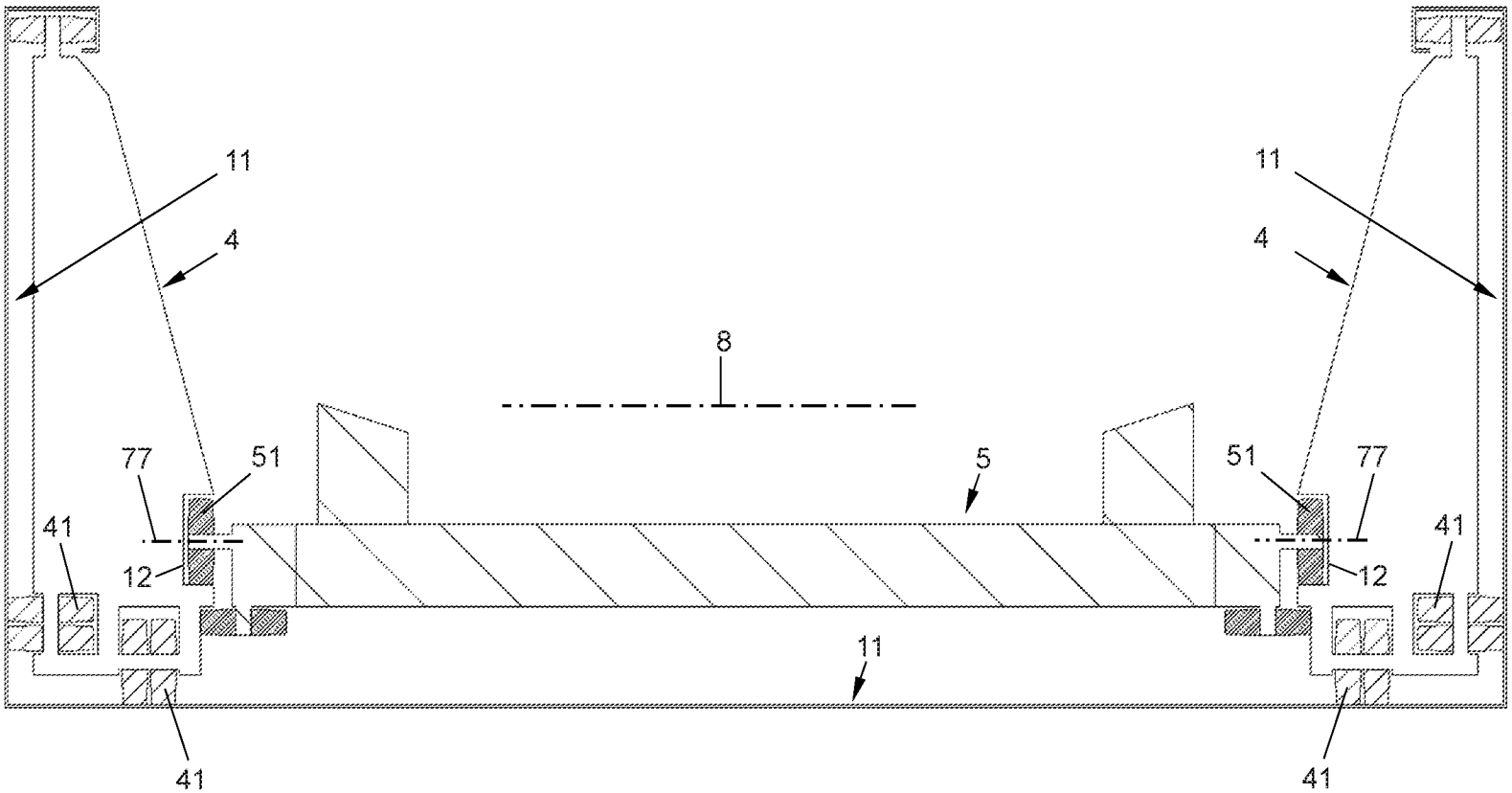
FIG. 6 shows, in a cross-sectional view perpendicular to the stern ramp length axis, an example of embodiments of the first translation guiding structure and the second translation guiding structure for use in a system according to the invention.

To illustrate how the telescopic moveability of the system may for example be realized, it is now temporarily referred to FIG. 6, which shows an example of the abovementioned first translation guiding structure, in this case a large steel profile 11, which may be attached to the stern of the mother ship 2. Via wheels 41 of the main frame 4, the main frame 4 may reciprocally translate relative to this first translation guiding structure 11 along the inclined stern ramp length axis 7. Furthermore, FIG. 6 shows an example of the abovementioned second translation guiding structure, in this case grooves 12 in the main frame 4. Via wheels 51 of the landing frame 5, which wheels 51 are running in said grooves 12, the landing frame 5 may reciprocally translate relative to the main frame 4 along the inclined stern ramp length axis 7. Note that in FIGS. 1A through 5 the positions of these wheels 51 along the inclined stern ramp length axis 7 have schematically been indicated by circles/dots 51.

Now reverting to FIGS. 1A through 5 again, the translation movement mechanism, the rotation guiding structure, and the rotation movement mechanism of system 1 are explained as follows. The rotation guiding structure of system 1 comprises the shown first auxiliary frame 6, which via the shown hinges 62 (one on starboard side, the other on port side) is pivotably connected to the landing frame 5. In addition, this first auxiliary frame 6 is also pivotably, as well as translatably, connected to the main frame 4 via wheels 61 of the first auxiliary frame 6, which wheels 61 are running in the grooves 12 in the main frame 4, in a similar manner as the wheels 51 do (see the explanation above, which refers to FIG. 6). Hence, similarly, in FIGS. 1A through 5 also the positions of these wheels 61 along the inclined stern ramp length axis 7 have schematically been indicated by circles/dots 61.

By comparing the telescopic extended position of FIGS. 3A, 3B with the boat landing pivot position of FIGS. 4A, 4B it will readily be appreciated that the shown piston/cylinder combinations 22 (one on starboard side, the other on port side) function as the rotation movement mechanism which effects and controls the movements of the landing frame 5 according to said reciprocally pivotable manner. That is, in FIGS. 4A, 4B, the piston/cylinder combinations 22 are in a relatively retracted state, while in FIGS. 3A, 3B, the piston/cylinder combinations 22 are in a relatively extended state. Also, it will readily be appreciated that, in the shown example, the combination of the first auxiliary frame 6, the wheels 51 and 61, and the hinges 62 function as the rotation guiding structure, which guides the movements of the landing frame 5 according to said reciprocally pivotable manner. It is noted that, in the shown example, the abovementioned pivot axis defining the abovementioned reciprocally pivotable manner in which the landing frame is held by the main frame and by the rotation guiding structure, is formed by the axis 77 of the wheels 51, see FIG. 6. The position of this pivot axis 77 has also been indicated in FIGS. 3A, 3B, 4A, 4B, 5.

In the shown example, the abovementioned translation movement mechanism comprises a winch system 21, which in the schematical Figures is shown only partly by means of only one schematical pulley and only one schematical cable. In practice, however, the winch system will in general comprise many more components, including additional pulleys, etc. In the schematical Figures it is seen that the shown cable of the winch system 21 has been shown to be connected to the first auxiliary frame 6. This has been done only for simplicity of presentation. The skilled person will readily appreciate how to arrange the system for effecting and controlling movements according to said first reciprocally translatable manner and said second reciprocally translatable manner, based on a winch system.

As mentioned above, in a preferable embodiment of a system according to the invention, the translation movement mechanism may be configured to effect that movements, according to said first reciprocally translatable manner, of the main frame relative to the stern, on the one hand, and movements, according to said second reciprocally translatable manner, of the landing frame relative to the main frame, on the other hand, take place simultaneously and in the same direction of said inclined stern ramp length axis. Also, it has been mentioned above that said simultaneity of movements in said same direction offers the advantage that it speeds up the retracting and extending movements of the telescopic stern ramp of the system. The embodiment of FIGS. 1A, 1B, 2A, 2B, 3A, 3B is an example of this preferable embodiment having said simultaneity of movements in said same direction. This is perhaps best seen by looking at the consecutive FIGS. 1B, 2B, 3B only, which illustrate three successive moments in time, respectively, during the launching operation, in which the movements according to said first and second reciprocally translatable manners are each continuous movements. Comparing FIG. 2B with FIG. 1B, one sees that the main frame 4 has moved downhill relative to the stern, while at the same time the landing frame 5 has moved downhill relative to the main frame 4. Furthermore, comparing FIG. 3B with FIG. 2B, one sees that the main frame 4 has moved further downhill relative to the stern, while at the same time the landing frame 5 has moved further downhill relative to the main frame 4. It is noted that different ratios between the relative movement speed according to said first translatable manner, on the one hand, and the relative movement speed according to said second translatable manner, on the other hand, are possible in this preferable embodiment. It is furthermore noted that the skilled person will readily be able to effect and control this preferable embodiment having said simultaneity of movements in said same direction, based on technologies known in the art. For this reason, and in view of simplicity of presentation, detailed drawings showing further details of this preferable embodiment have been omitted.

The sensor and calculator, both as mentioned above, have schematically been shown in FIGS. 1A, 2A, 3A, 4A, 5, indicated therein by the reference numerals 9 and 10, respectively. In the shown example, two such sensors 9 (as well as two such calculators 10) have been installed at the end of the stern of the mother ship 2, on port side and starboard side, respectively. These sensors and calculators are mounted on arms of turning poles. FIG. 1A shows these poles turned into stowing positions of the sensors and calculators, while the other FIGS. 2A, 3A, 4A, 5 show the poles turned into use positions. Note that, for reasons of simplicity, these poles with the sensors 9 and the calculators 10 have been omitted from FIGS. 1B, 2B, 3B, 4B.

Figure 7A:
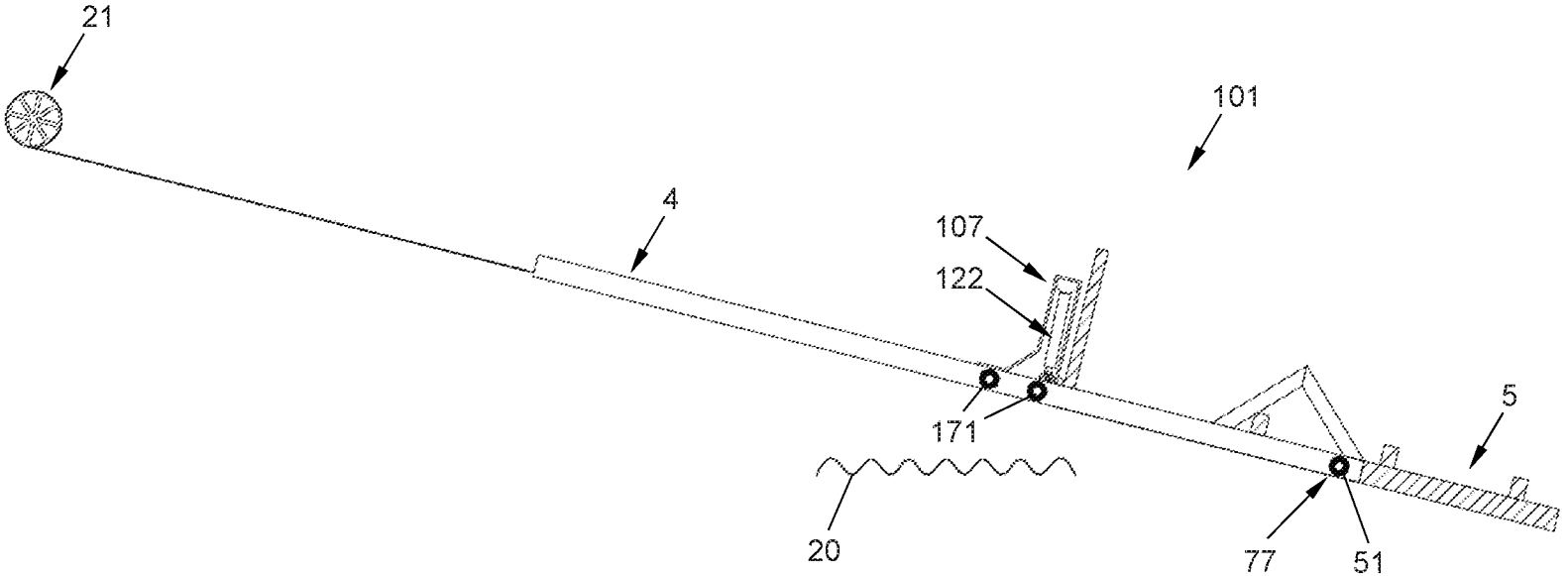
FIG. 7A shows an example of another embodiment of a stern ramp launch and recovery system according to the invention, wherein the landing frame is in the telescopic extended position, and in a side view being very similar to FIG. 3B, however this time with omitted ship's hull of the mother ship.
Figure 7B:
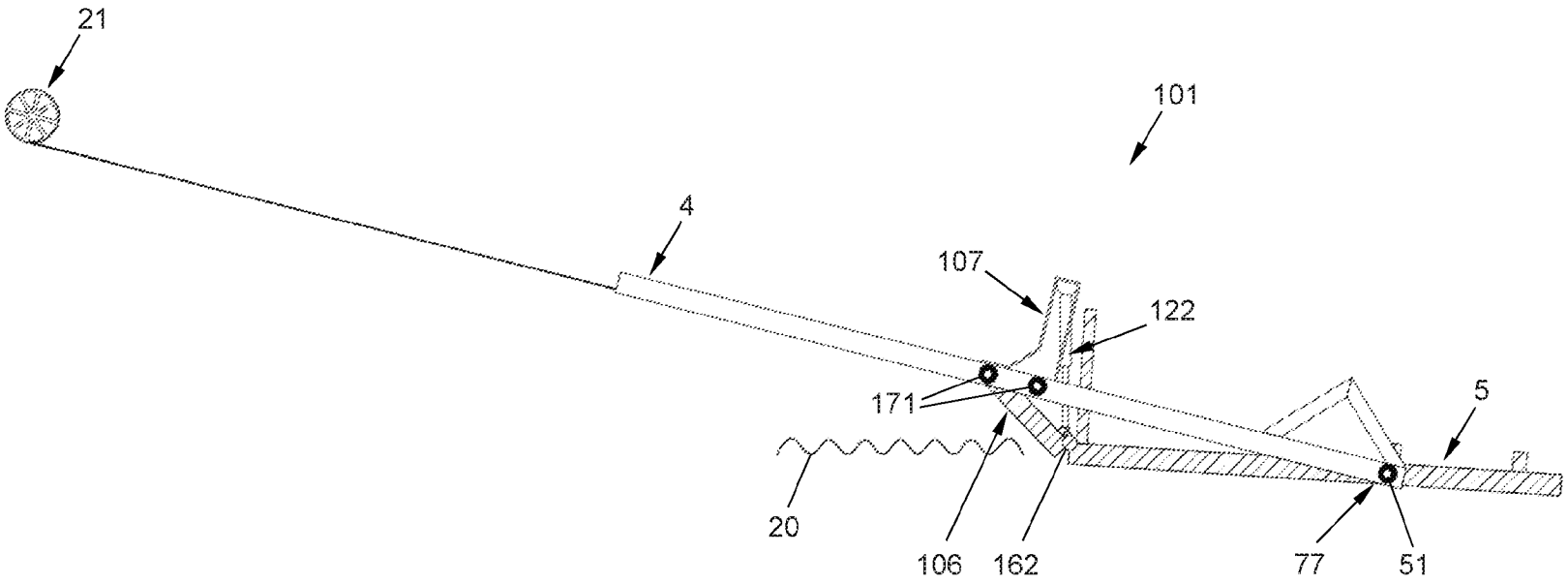
FIG. 7B shows the similar situation of FIG. 7A again, however, wherein the landing frame has now been pivoted from the telescopic extended position into the boat landing pivot position.

Now, reference is made to FIGS. 7A, 7B, which show the abovementioned other embodiment of a stern ramp launch and recovery system according to the invention, i.e. the shown system 101. The system 101 embodiment of these FIGS. 7A and 7B is best understood when comparing FIGS. 7A and 7B with the analogous FIGS. 3B and 4B, respectively, of the system 1 embodiment. It is seen that the system 101 comprises the same main frame 4, the same landing frame 5, and the same winch system 21 as the system 1. Furthermore, the rotation guiding structure of system 101 comprises the shown first auxiliary frame 106, which via the shown hinges 162 is pivotably connected to the landing frame 5. The first auxiliary frame 106 and the hinges 162 of system 101 are very similar to the first auxiliary frame 6 and the hinges 62 of system 1. The main difference between system 101 and system 1 is that system 101 additionally has the shown second auxiliary frame 107. This second auxiliary frame 107 has a number of wheels 171, which wheels 171 are running in the grooves 12 in the main frame 4, in a similar manner as the wheels 51 do (see the explanation above, which refers to FIG. 6). Hence, similarly, in FIGS. 7A, 7B also the positions of these wheels 171 along the inclined stern ramp length axis 7 have schematically been indicated by the shown circles 171. One pair of wheels 171 is located on port side, while the other pair of wheels 171 is located on starboard side. Hence, the second auxiliary frame 107 is only translatably (not pivotably) connected to the main frame 4 via wheels 171 of the second auxiliary frame 107. By comparing the telescopic extended position of FIG. 7A with the boat landing pivot position of FIG. 7B it will readily be appreciated that the shown piston/cylinder combinations 122 (one on port side, the other on starboard side) function as the rotation movement mechanism which effects and controls the movements of the landing frame 5 according to said reciprocally pivotable manner. That is, in FIG. 7A the piston/cylinder combinations 122 are in a relatively retracted state, while in FIG. 7B, the piston/cylinder combinations 122 are in a relatively extended state. Note that the first auxiliary frame 106 and the second auxiliary frame 107 are translatably, as well as pivotably interconnected relative to one another by means of interconnections (not shown in FIGS. 7A and 7B), which may be similar to the translatable, as well as pivotable, interconnections 61 between the first auxiliary frame 6 and the main frame 4 of system 1.

While the invention has been described and illustrated in detail in the foregoing description and in the drawing figures, such description and illustration are to be considered exemplary and/or illustrative and not restrictive; the invention is not limited to the disclosed embodiments.

As an example, it is noted that in the shown embodiments the translation movement mechanisms comprise winch systems 21, while the rotation movement mechanisms comprise piston/cylinder combinations 22, 122. However, instead of or in addition to a winch system, it is possible to apply, in the translation movement mechanism of a system according to the invention, various other movement systems, including hydraulic and/or pneumatic systems and/or chain systems, etc., and, if desired, also including piston/cylinder combinations. Similarly, instead of or in addition to piston/cylinder combinations, it is possible to apply, in the rotation movement mechanism of a system according to the invention, various other movement systems, including hydraulic and/or pneumatic systems and/or chain systems, etc., and, if desired, also including winch systems.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. For the purpose of clarity and a concise description, features are disclosed herein as part of the same or separate embodiments, however, it will be appreciated that the scope of the invention may include embodiments having combinations of all or some of the features disclosed. The mere fact that certain measures are recited in mutually different dependent claims does not indicate that a combination of these measures can not be used to advantage. Any reference signs in the claims should not be construed as limiting the scope.

The invention claimed is:

1. Stern ramp launch and recovery system for launching, and recovering, a daughter boat from a stern of a mother ship, the system comprising a main frame, a landing frame for supporting the daughter boat, a first translation guiding structure, a second translation guiding structure, a translation movement mechanism, a rotation guiding structure, and a rotation movement mechanism, wherein the system is configured to be in an operation condition, in which the system is forming a telescopic stern ramp of the mother ship, said telescopic stern ramp having an inclined stern ramp length axis having a descending slope in rearward direction of the mother ship, and in which operation condition:

the first translation guiding structure is attached to the mother ship along the stern, whereby the first translation guiding structure defines said inclined stern ramp length axis, as well as a corresponding stern ramp width axis, of said telescopic stern ramp;

the main flame is held by the mother ship and by the first translation guiding structure in a first reciprocally translatable manner along said inclined stern ramp length axis, said first translatable manner being relative to the stern;

the landing frame is held by the main frame and by the second translation guiding structure in a second reciprocally translatable manner along said inclined stern ramp length axis, said second translatable manner being relative to the main frame;

the translation movement mechanism effects and controls movements according to said first reciprocally translatable manner and said second reciprocally translatable manner;

said first reciprocally translatable manner and said second reciprocally translatable manner are allowing the landing frame to reciprocally translate between at least one telescopic retracted position and at least one telescopic extended position, wherein the landing frame in its telescopic extended position is farther descended along said inclined stern ramp length axis than in its telescopic retracted position;

the landing frame is held by the main frame and by the rotation guiding structure in a reciprocally pivotable manner relative to the main frame, about a pivot axis being parallel to said stern ramp width axis, between said telescopic extended position of the landing frame and at least one boat landing pivot position in which the landing frame has less inclination as compared to the inclined stern ramp length axis; and the rotation movement mechanism effects and controls movements according to said reciprocally pivotable manner.

2. Stern ramp launch and recovery system according to claim 1, wherein the translation movement mechanism is configured to effect that:

movements, according to said first reciprocally translatable manner, of the main frame relative to the stern, on the one hand; and movements, according to said second reciprocally translatable manner, of the landing frame relative to the main frame, on the other hand;

take place simultaneously and in the same direction of said inclined stern ramp length axis.

3. Stern ramp launch and recovery system according to claim 1, wherein the rotation guiding structure comprises a first auxiliary frame, which is configured to follow the landing frame to reciprocally translate between said at least one telescopic retracted position and said at least one telescopic extended position, and which is hingeably connected to the landing frame with a hinge axis being parallel to said stern ramp width axis and being spaced from said pivot axis.

4. Stern ramp launch and recovery system according to claim 1, further comprising at least one sensor, which in said operation condition is configured, arranged and effective to sense at least one property of water waves in the neighbourhood of the mother ship.

5. Stern ramp launch and recovery system according to claim 4, further comprising at least one calculator, which is communicatively connected to said at least one sensor, and which in said operation condition is configured, arranged and effective to calculate, based on said at least one property sensed by said at least one sensor:

a suitable moment in time for starting up launching or recovering a daughter boat by means of the stern ramp launch and recovery system; and/or proposed operation parameters of the stern ramp launch and recovery system; and/or proposed alterations in the sailing characteristics of the mother ship relative to the water waves in the neighbourhood of the mother ship, which proposed alterations are influencing the relative movements between said water waves and the mother ship in a manner so as to make launching or recovering a daughter boat by means of the stern ramp launch and recovery system easier and/or safer.

6. Assembly of a stern ramp launch and recovery system according to claim 1, and a mother ship, wherein the stern ramp launch and recovery system is installed in its operation condition on the mother ship.

7. Method of launching, and recovering, a daughter boat from a stern of a mother ship, wherein:

a stern ramp launch and recovery system according to claim 1 is installed in its operation condition on the mother ship;

said recovering comprises the consecutive steps of:

(i) sailing the daughter boat onto the landing frame being in a first one of said at least one boat landing pivot position, while fastening the daughter boat, sailed onto the landing frame, to the landing frame;

(ii) pivoting the landing frame from said first boat landing pivot position into a first one of said at least one telescopic extended position;

(iii) translating the landing frame from said first telescopic extended position into a first one of said at least one telescopic retracted position;

and said launching comprises the consecutive steps of:

(iv) translating the landing frame from a second one of said at least one telescopic retracted position into a second one of said at least one telescopic extended position, while the landing frame is supporting the daughter boat, which is fastened thereto;

(v) pivoting the landing frame from said second telescopic extended position into a second one of said at least one boat landing pivot position;

(vi) unfastening, in said second boat landing pivot position, the daughter boat from the landing frame and releasing the daughter boat from the landing frame.

* * * * *